United States Patent [19]

Clemente

[11] Patent Number: 4,875,521

[45] Date of Patent: Oct. 24, 1989

[54] ELECTRIC FAN ASSEMBLY FOR OVER-THE-ROAD TRUCKS

[76] Inventor: Roger Clemente, 1789 Vauxhall Rd., Union, N.J. 07083

[21] Appl. No.: 19,693

[22] Filed: Feb. 27, 1987

[51] Int. Cl.[4] ..... F01P 7/02

[52] U.S. Cl. ..... 165/39; 165/41; 165/51; 123/41.12; 123/41.49; 236/35

[58] Field of Search ..... 123/41.11, 41.12, 41.49; 165/41, 51, 39; 236/35

[56] References Cited

U.S. PATENT DOCUMENTS

| | | | |
|---|---|---|---|
| 4,257,554 | 3/1981 | Willingham | 123/41.12 |
| 4,313,402 | 2/1982 | Lehnhoff et al. | 123/41.49 |
| 4,329,946 | 5/1982 | Longhouse | 123/41.49 |
| 4,366,783 | 1/1983 | Clemente | 123/41.12 |
| 4,469,053 | 9/1984 | Sakurai | 123/41.12 |
| 4,489,680 | 12/1984 | Spokas et al. | 123/41.12 |
| 4,546,742 | 10/1985 | Starges | 123/41.12 |
| 4,548,548 | 10/1985 | Gray, III | 123/41.49 |
| 4,590,772 | 5/1986 | Nose et al. | 123/41.12 |
| 4,651,922 | 3/1987 | Noba | 123/41.12 |
| 4,682,649 | 7/1987 | Greer | 62/236 |

*Primary Examiner*—John Ford

*Attorney, Agent, or Firm*—Louis E. Marn

[57] ABSTRACT

There is disclosed an over-the-road truck having an internal combustion engine of at least 200 hp including a radiator and an electric fan assembly therefor consisting of an electric motor to which is attached an axial flow propeller fan and operating only when necessary and of a minimum wattage determined by $W=1.75E$ wherein E is the engine horsepower provided that the core size ($in^2$) of the radiator is 3E and the air flow (CFM) therethrough is at least 22.5E.

8 Claims, 2 Drawing Sheets

ELECTRIC FAN ASSEMBLY FOR OVER-THE-ROAD TRUCKS

FIELD OF THE INVENTION

This invention relates to cooling assemblies for vehicles, and more particularly to an electrically-driven fan assembly for the radiator of an over-the-road truck having internal combustion engines of at least 200 hp.

BACKGROUND OF THE INVENTION

Generally, to effect a flow of air through the radiator core or heat exchanger sufficient to effect heat transfer of the coolant, a fan assembly attached to the engine is provided on the motor side of the radiator to draw air therethrough. The rotation of the fan blades is directly related to the RPMs of the engine. Thus, the slower the rotation of the fan, the smaller the quantity of forced air flow.

Most cooling requirements of an internal combustion engine vary with the speed of the vehicle. Generally, cooling is most important 5% to 10% of the time during idling, slow speeds, or climbing steep grades, since natural convection at vehicle speeds in excess of 20 to 30 mph is sufficient to effect air flow through the radiator to maintain proper operating temperatures. During normal operation, the air passing through the radiator by the vehicle's forward motion is sufficient to keep the engine cool; no fan is necessary.

Currently, to help increase fuel economy on trucks, Original Equipment Manufacturers (OEMs) have used both engine-driven on-off or modulating fan clutches. Obviously, these types of fan drives require up to 30 hp to rotate when they are engaged, reducing overall fuel economy and engine efficiency. Furthermore, the fan drives: (1) must be turned directly by a belt from the engine; (2) restrict the modifications that can be done to the engine and chassis because the engine, radiator and fan must be adjacent and on the same plane; (3) are prone to maintenance problems because the fan or fan hubs are in constant rotation; (4) reduce life expectancy of belts and water pumps because of the strain the fan places on them when it is engaged; (5) cause vibration because they are attached to the engine; (6) are expensive to install; and (7) tend to overcool the engine, creating sludge deposits that cause premature engine wear.

It has been the practice of Original Equipment Truck Manufacturers to overcool their engines because:

(1) They offer prolonged warranties. During this coverage they want to make certain that if the vehicle comes into contact with a harsh environment that contains contaminants (dust or dirt), partly clogging the radiator, there is enough air flow to maintain proper engine temperatures. The OEMs over-design the CFM requirements to compensate for improper maintenance.

(2) Economically, it is less expensive to manufacture vehicles having the same components, thereby reducing the number of different parts, certifications, and designs. OEMs build trucks with the same components, even though they may be used for different purposes, and therefore require different air flows. For example, a stationary application such as a sanitation truck which uses its engine at high idle to load and unload has a greater air flow demand than an over-the-road truck that benefits from ram air cooling.

Electric fans for engine cooling have been successfully used on automobile engines for years; however, on truck applications that benefit from ram air cooling (air forced through the radiator by the vehicle's forward motion), both the Society of Automotive Engineers and the Original Equipment Manufacturers have rejected their use, since it is their position that a multiple of electric fans are inadequate and cannot provide the same cooling capabilities of belt-driven on-off, viscous, or direct-drive fans that are currently used.

OBJECTS OF THE INVENTION

It is an object of the present invention to provide an improved fan assembly for a radiator of an internal combustion engine for an over-the-road truck providing for a substantial increase in operating efficiency.

Another object of the present invention is to provide an improved fan assembly for a radiator of an internal combustion engine for an over-the-road truck resulting in increased fuel economy.

A further object of the present invention is to provide an improved fan assembly for a radiator of an internal combustion engine for an over-the-road truck resulting in increased horsepower.

Yet another object of the present invention is to provide an improved fan assembly for heat exchanger applications mounted in a non-conventional position.

Still another object of the present invention is to provide an improved fan assembly that reduces maintenance costs.

Still yet another object of the present invention is to provide an improved fan assembly that creates less noise and reduces vibration.

A still further object of the present invention is to provide an improved fan assembly for a radiator of an internal combustion engine for an over-the-road truck with improved warm-up capabilities and temperature control.

Yet a further object of the present invention is to provide a fully modular fan system for truck applications.

SUMMARY OF THE INVENTION

These and other objects of the present invention are achieved for an over-the-road truck having an internal combustion engine of at least 200 hp including a radiator and an electric fan assembly therefor consisting of an electric motor to which is attached an axial flow propeller fan and operating only when necessary and of a minimum wattage determined by $W=1.75E$ wherein E is the engine horsepower provided that the core size ($in^2$) of the radiator is 3E and the air flow (CFM) therethrough is at least 22.5E.

BRIEF DESCRIPTION OF THE DRAWINGS

These and other objects of the present invention will become clear by reference to the following detailed description when taken with the accompanying drawings where like numerals designate like parts throughout and wherein.

DETAILED DESCRIPTION OF THE DRAWINGS

Figure 1:
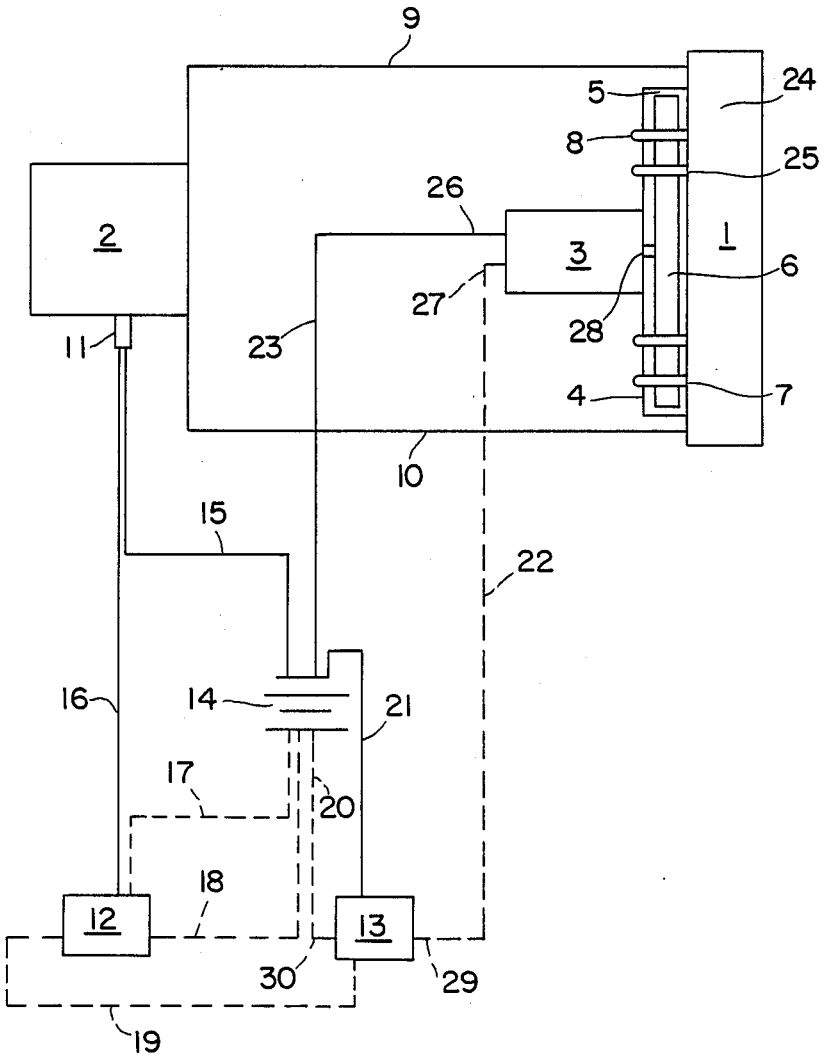
FIG. 1 is a plane side view of a radiator and fan assembly of the present invention.
Figure 3:
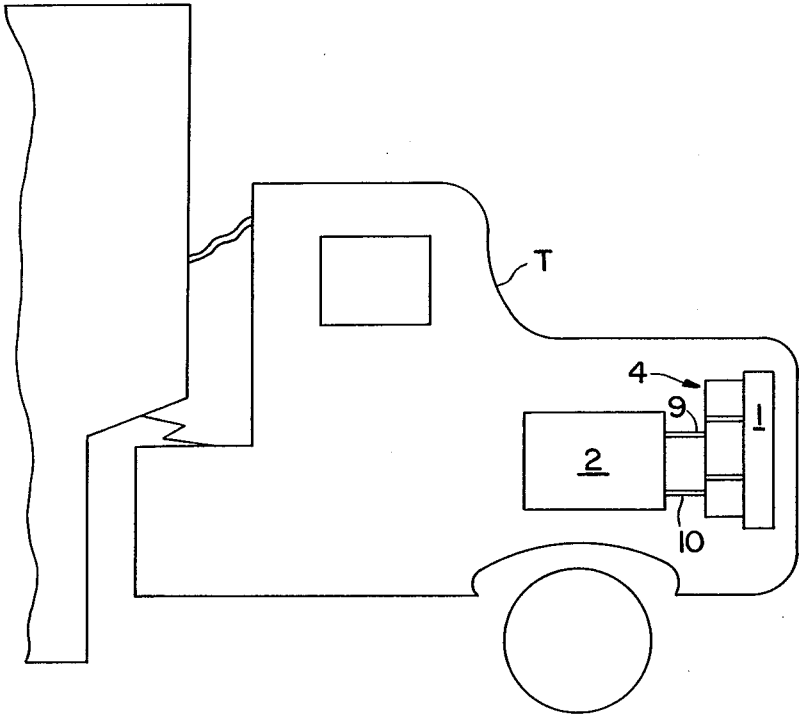
FIG. 3 is an elevational view of an over-the-road truck provided with electric fan assembly of the present invention.
Figure 2:
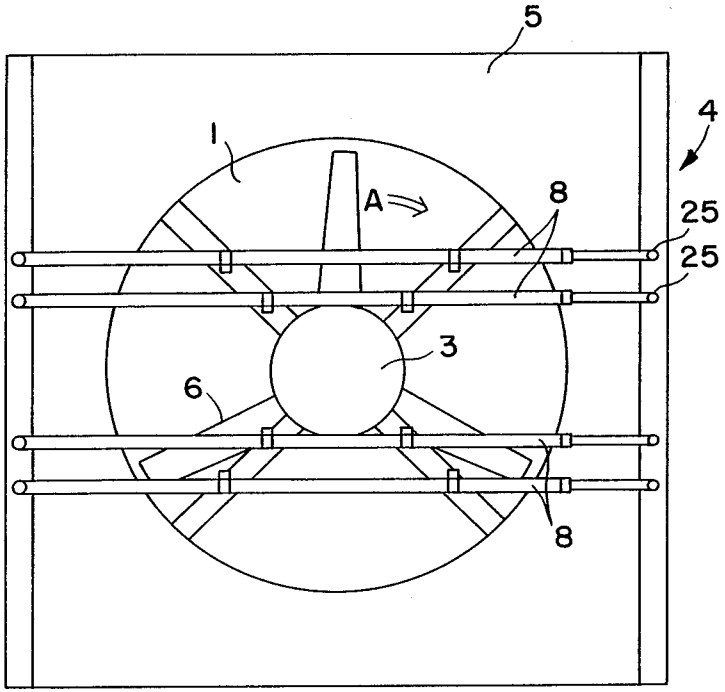
FIG. 2 is a right side elevational view thereof.

Referring now to the drawings, there is illustrated a radiator assembly, generally indicated as 1, for an internal combustion engine of the truck type having a coolant inlet conduit 10 and coolant outlet conduit 9. The radiator assembly 1 is of the core type including conduits 24 (one shown) and a fan assembly, generally indicated as 4, to improve the conductive heat transfer between the air flowing through the radiator assembly 1 and coolant flowing through the conduits 24.

Disposed between the radiator assembly 1 and internal combustion engine 2, there is provided the fan assembly 4, comprised of an electric motor 3, axial fan blades 6, and shroud 5, mounted to the radiator assembly 1 by spacer elements 7 for positioning support bars 8. The support bars 8 are mounted, such as by bolt and stud assemblies 25, to the housing of the electric motor 3 including a shaft 28 on which are mounted axial fan blades 6. The axial fan blades 6 provide maximum efficiency since their diameter covers as much of the radiator core as possible.

The electric motor 3 is provided with terminal leads 26 and 27 and when energized causes the rotor (not shown) mounted about shaft 28 to rotate and thereby rotate the axial fan blades 6. The terminal lead 26 is connected by a conductor 23 to a negative power source, such as battery 14, that is grounded to the chassis of the vehicle. Terminal lead 27 of electric motor 3 is connected to the main current terminal 29 of power relay 13 via conductor 22 which supplies the positive input current to electric motor 3. Terminal 30 of the power relay 13 is connected to the positive side of the battery 14 via conductor 20. Current passing through power relay 13 is controlled by the triggering coil (not shown) of power relay 13 that is connected to the negative side of battery 14 via conductor 21. The opposite positive side of the triggering coil of power relay 13 is connected to the switching relay 12 via conductor 19. The electric motor 3 starts and stops by opening and closing of the triggering coil of the power relay 13, completing the circuit for positive current to pass from the battery 14 through terminal 30 and main current terminal 29 of power relay 13 to the electric motor 3 via terminal lead 27.

The switching relay 12, which controls the triggering coil of power relay 13, has one of its coil terminals connected to the thermostat 11 via conductor 16, which carries negative power. The opposite side of the coil is connected to positive power of battery 14 via conductor 17. As the coil of the switching relay 12 is energized, positive current from battery 14 is passed from conductor 18 through switching relay 12 through conductor 19 to power relay 13.

The thermostat 11 is normally open. One terminal of the switch is connected to the negative side of the battery 14 via conductor 15. The other side of thermostat 11 is connected to the negative side of the coil of switching relay 12 via conductor 16.

The thermostat 11 may be positioned preferably in the lower portion of the radiator or engine block. In air conditioning applications (not shown), a pressure switch is installed on the high side of the system.

The thermostat 11 is preferably selected to respond to a closed mode between a temperature of from 180° F. to 200° F. and to respond to an open mode at a coolant temperature of from 160° F. to 180° F.

In accordance with the present invention, the electric motor 3 of the fan assembly 4 for an over-the-road truck having an engine of at least 200 hp must have a minimum wattage as determined by the following empirical equation:

$$W=1.75E$$

wherein:

W = wattage of electric motor, and

E = Horsepower of Engine provided that the size of the associated radiator ($in^2$) is at least 3E for a minimum air flow rate (CFM) of 22.5E.

In operation, upon keying the ignition switch (not shown) of the vehicle provided with a fan assembly 4 of the present invention, the electric motor 3 is in a disabled state and remains in such state until the temperature of the coolant reaches a predetermined temperature, e.g. 185° F., sensed by the thermostat 11, at which point the thermostat closes, completing a circuit via the battery 14, thereby energizing the switching relay 12 and the power relay 13, which in turn energizes electric motor 3, causing the shaft 28 and the axial fan blades 6 to rotate in a clockwise direction (illustrated by arrow A). Upon rotation, the center of the axial fan blades 6 first comes into contact with the air, thereby moving the air outwardly toward the ends of the axial fan blades 6, thereby drawing air through the radiator assembly 1.

The thermostat 11 remains closed until a predetermined lower temperature (e.g. 165° F.) is reached, caused for example by exceeding about 20 to 30 miles per hour for extended time periods, whereby the forced convection through the radiator assembly 1 is sufficient to maintain the coolant temperature at the desired operating level. Upon reaching this temperature, the thermostat 11 opens, de-energizing the system.

As hereinabove mentioned, the fan assembly 4 is preferably mounted between the radiator assembly 1 and internal combustion engine 2 whereby rotation of the axial fan blades 6 of the fan assembly draws air through the radiator assembly 1, although the fan assembly 4 of the present invention may be mounted in front of the radiator assembly 1 to push air through the radiator assembly 1. It is readily appreciated that under sustained driving conditions, wherein the vehicle exceeds a speed of about 20 to 30 miles per hour, the electric motor 3 is disabled but the axial fan blades 6 are permitted to rotate by the passage of forced air. Energy savings are realized dependent on the energy required to rotate a belt-driven fan (up to about 30 hp) which, when converted to an increase in fuel economy, amounts to up to 10% to 15% or more, since the fan assembly 4 of the present invention is operated only on a "when needed" basis, and is of reduced amperage.

The fan assembly 4 of the present invention may be included as original equipment on the truck or may replace an existing unit. Additionally, the fan assembly of the present invention may be used as original or replacement equipment in conjunction with heat exchangers requiring forced convection to cool a fluid, such as oil, or an intermediate heat transfer fluid, such as freon, for air conditioners, refrigerators, charge air, and the like. Thus, the fan assembly 4 of the present invention is mounted proximate to the heat exchanger preferably in a position to draw air through the heat exchanger with the thermostat being responsive to preselected temperature levels with the electric motor 3 being driven by a source of electric current including DC or AC sources, such as a battery or current source, respectively.

EXAMPLES OF THE INVENTION

The following examples are intended to be merely illustrative of the present invention and are not to be regarded as limiting thereto.

Example 1

A twenty-thousand pound (20,000 lb.) truck having an engine horsepower of 200 is to be provided with a radiator of a core size of 600 square inches ($3E=3\times200=600$) requiring 4500 CFM ($22.5E=22.5\times200=4500$) of air flow provided by an axial fan blade. The electric motor to drive the fan assembly is of a minimum wattage of 350, calculated as follows:

$$W=1.75\times200=350$$

Example 2

A sixty-thousand pound (60,000 lb.) truck having an engine horsepower of 350 is to be provided with a radiator of a core size of 1050 square inches ($3E=3\times350=1050$) requiring 7857 CFM ($22.5E=22.5\times350=7857$) of air flow provided by an axial fan blade. The electric motor to drive the fan assembly is of a minimum wattage of 612.5, calculated as follows:

$$W=1.75\times350=612.5$$

The apparatus of the present invention results in the following advantages:

(1) Improved fuel economy (up to 15%) and performance because it operates off batteries—not engine horsepower.
(2) Reduced maintenance costs since it is thermostatically controlled and operates only when necessary. Other types of on-off fans are constantly turning, wearing out internal components of the fan hub.
(3) Increased vehicle output by eliminating the large horsepower requirements of belt-driven on-off fans.
(4) Better control of engine temperature—increased motor life.
(5) Increased belt and water pump life.
(6) In most cases, decreased cost to install and maintain.
(7) Reduced vibration and noise since it is not attached to the motor.
(8) Elimination of fan alignment problems on vehicles, allowing greater flexibility in the design of cooling systems.
(9) Easier access to front-mounted engine accessories.
(10) Easy adaptation to many vehicles, reducing costly inventories.
(11) Elimination of the need for lubrication.
(12) Elimination of the need for an air source for fan engagement.
(13) Easy mounting, using our telescopic or flat steel mounting hardware.
(14) Easy relocation of heat exchangers.
(15) Better cooling at idle.

While the present invention has been described in connection with several exemplary embodiments thereof, it will be understood that many modifications will be apparent to those of ordinary skill in the art, and that this application is intended to cover any adaptations or variations thereof. Therefore, it is manifestly intended that this invention be only limited by the claims and the equivalents thereof.

What is claimed:

1. The combination of an over-the-road truck having an internal combustion engine of at least 200 hp and having a heat transfer assembly for cooling an intermediate heat transfer fluid for said internal combustion engine, said heat transfer assembly comprising exclusively an electric fan assembly to operate only when necessary to cool said heat transfer assembly and consisting of an electric motor including a shaft having an axial flow fan mounted thereon, and further comprising:

a support means for attaching said electric motor to said heat exchanger;

a battery for driving said electric motor; and a switch means to control starting and stopping of said electric motor, said electric motor having a minimum wattage calculated by the empirical equation:

$$W=1.75E$$

wherein:

W=wattage of electric motor, and

E=Horsepower of said internal combustion engine said heat transfer assembly having a core size determined by the empirical equation:

$$R=3E$$

wherein:

R=core size ($in^2$)

and said axial flow fan for said heat transfer assembly providing for air flow determined by the equation:

$$C=22.5E$$

wherein:

C=air flow (CFM).

2. The fan assembly as defined in claim 1 wherein said heat exchanger assembly is a radiator assembly for cooling a heat transfer fluid being circulated through an internal combustion engine of said truck.

3. The fan assembly as defined in claim 2 wherein said fan assembly is mounted between said radiator and said internal combustion engine and said axial fan blades are caused to rotate to draw air through said radiator assembly.

4. The fan assembly as defined in claims 1 or 2 wherein said switching means is a thermostat placed in a closed mode at a temperature of from 180° F. to 200° F. and an open mode at a temperature of from 160° F. to 180° F.

5. The fan assembly as defined in claim 1 to be used on over-the-road trucks with a gross vehicle weight of up to 100,000 lbs.

6. The fan assembly as defined in claim 1 capable of producing an air flow of from 4,500 CFM to 11,500 CFM.

7. The fan assembly as defined in claim 1 wherein said electric motor is rated between 350 WATTS to 1,200 WATTS.

8. The fan assembly as defined in claim 1 wherein said battery supplies direct current to said electric motor of said fan assembly.

* * * * *